US008398256B2

(12) United States Patent
Fridley

(10) Patent No.: US 8,398,256 B2
(45) Date of Patent: Mar. 19, 2013

(54) MAGNETIC ACCESSORY MOUNTS

(75) Inventor: Steven Marlin Fridley, Round Rock, TX (US)

(73) Assignee: Defender Innovations, Inc., Round Rock, TX (US)

( * ) Notice: Subject to any disclaimer, the term of this patent is extended or adjusted under 35 U.S.C. 154(b) by 0 days.

(21) Appl. No.: 13/009,203

(22) Filed: Jan. 19, 2011

(65) Prior Publication Data

US 2011/0235346 A1 Sep. 29, 2011

Related U.S. Application Data

(60) Provisional application No. 61/317,197, filed on Mar. 24, 2010.

(51) Int. Cl.
*F21V 21/096* (2006.01)

(52) U.S. Cl. ..... 362/110; 362/191; 362/398

(58) Field of Classification Search ..... 362/110, 362/190, 191, 398; 42/99, 113, 146
See application file for complete search history.

(56) References Cited

U.S. PATENT DOCUMENTS

| | | | | |
|---|---|---|---|---|
| 4,506,317 | A * | 3/1985 | Duddy | 362/396 |
| 6,267,487 | B1 * | 7/2001 | Tucker et al. | 362/382 |
| 2002/0105797 | A1 * | 8/2002 | Navid et al. | 362/120 |
| 2003/0090894 | A1 * | 5/2003 | Cummings | 362/110 |

* cited by examiner

*Primary Examiner* — Laura Tso
(74) *Attorney, Agent, or Firm* — Robert L. Villhard

(57) ABSTRACT

Apparatus for mounting accessories to guns. Some embodiments provide gun mounts each including a body and a magnet to magnetically couple the mount to the gun. The bodies are shaped and dimensioned to mechanically retain the accessories (which can be flash lights). The magnets are mechanically coupled to the bodies (and can be an integral portion thereof) and cause magnetic fields. Given the shapes and dimensions of the bodies, the positions of the magnets relative to the bodies and relative to the barrels of the guns when the bodies abut the barrels, the magnetic field strengths are within a range sufficient to releasably and magnetically couple the magnets and the barrels. In some embodiments the magnetic field strengths are sufficient to limit the ranges of motion of the mounts relative to the guns during the shock created by firing the gun.

19 Claims, 4 Drawing Sheets

MAGNETIC ACCESSORY MOUNTS

CROSS-REFERENCE TO RELATED APPLICATIONS

This application claims priority to U.S. Provisional Patent Application No. 61/317,197 filed on Mar. 24, 2010 by Steven Fridley the entirety of which is incorporated herein by reference as if set forth in full.

BACKGROUND

Gun users sometimes find it convenient to rapidly mount and remove accessories from their guns. For instance, at times, it might be useful to have a light producing device (hereinafter a "light") mounted on the barrel of the gun and shining in the direction toward which the gun is aimed. For instance, military personal, security officials, etc. might find themselves in a darkened environment wherein an armed confrontation might happen. Since non-combatants, other "friendly forces," etc. might be caught in that same darkened environment they face a risk of injury or death should the user of the gun fire it in their direction in the belief (because of the darkened environment) that the friendly force is a foe. In contrast, should the user of the gun hesitate in firing the gun (due to uncertainty as to the identity of the individual), the enemy combatant and/or other desired targets might escape or turn and attack.

Some gun users have therefore attempted to mount lights on their guns with limited success in dealing with such "friendly fire" scenarios. For instance, if mounting the light on the gun requires too much time, the delay in mounting the light might totally negate the advantage of having the light in the first place. In other words, while the gun user struggles with mounting the light on the gun, the desired target might flee the scene, turn on the gun user, turn on others, etc. Also, if the mounting assembly is of insufficient mechanical strength, the shock from firing the gun might cause the mounting assembly to become loose or to become separated from the gun.

SUMMARY

The following section presents a simplified summary in order to introduce some aspects of the disclosed subject matter. This summary is not an extensive overview of the disclosed subject matter, and is not intended to identify key or critical elements or to delineate the scope of such subject matter. A purpose of the summary is to present some concepts in a simplified form as a prelude to the more detailed disclosure that is presented herein.

Thus, some embodiments disclosed herein provide apparatus for mounting accessories to weapons (for instance, guns). Such embodiments provide accessory mounts wherein each includes a body and a magnet to magnetically couple the mount to the gun. The bodies are shaped and dimensioned to mechanically retain the accessories (which can be flash lights) therein. The magnets are mechanically coupled to the bodies, can be an integral portion thereof, and of course cause magnetic fields. Once selected various characteristics (for instance, the shapes and dimensions of the bodies, the positions of the magnets relative to the bodies, and the positions of the magnets relative to the barrels of the guns when the bodies abut the barrels, the magnetic field strengths) cause a magnetic forces within a range sufficient to releasably and magnetically couple the magnets and the barrels. In some embodiments the magnetic field strengths are sufficient to limit (during the shock created by firing the guns) the range of motion of the accessory mounts relative to the guns.

Some embodiments provide apparatus for mounting accessories to guns. The bodies of such accessory mounts define mounting cavities to receive the barrels of the weapons. In addition, or in the alternative, the apparatus can include a plurality of magnets positioned relative to the bodies to be adjacent to the barrels of the weapons when the apparatus are magnetically coupled to the weapons. If desired, the bodies can be shaped and dimensioned to align the accessories and the barrels of the weapons. Moreover, the bodies can define detents which can be integral parts of the bodies and which can be shaped and dimensioned to release the accessories. In some embodiments, the magnets are on the surfaces of the bodies whereas in some embodiments the magnets are in the bodies.

In the alternative, or in addition, some embodiments provide mounts to mount accessories to guns. The mounts of these embodiments include bodies shaped and dimensioned to mechanically receive the accessories and various components of the guns. The magnets are mechanically coupled to the bodies and cause magnetic fields sufficiently strong to couple the accessory mounts to the gun components.

Various embodiments provide apparatus with magnets mechanically coupled to bodies of the apparatus and which cause magnetic fields with strengths sufficient (in conjunction with the shapes and dimensions of the bodies, the positions of the magnets relative to the bodies and the positions of the magnets relative to the barrels when the bodies abut the weapons) to releasably and magnetically couple the magnets and the barrels of the weapons. The magnetic fields can also be sufficient to (in light of the geometry of the mounts and/or weapons) limit the ranges of motion of the mounts relative to the weapons during the firing of the weapons to about one quarter of an inch.

In some embodiments, the magnets are integral portions of the accessory mount bodies. Furthermore, some individual apparatus of embodiments can include pluralities of magnets. These magnets, for a given apparatus, can be arranged in one or more rows. Moreover, the rows of magnets can be positioned relative to the bodies such that one row abuts the barrel of the weapon and, for instance, another row of magnets can abut a magazine of the weapon when the body abuts the gun. In the alternative, or in addition, an air gap (whether empty or partially filed) can separate the accessory mount from the weapon.

The body of some apparatus defines accessory and weapon cavities for receiving respectively the accessories and components of the weapons. Moreover, the body of some apparatus are shaped and dimensioned to align the accessory along longitudinal axes of the weapon components. For instance, the accessory can be a flashlight to be aligned with the barrel of a gun.

To the accomplishment of the foregoing and related ends, certain illustrative aspects are described herein in connection with the figures. These aspects are indicative of various ways in which the disclosed subject matter may be practiced, all of which are intended to be within the scope of the disclosed subject matter without limiting the same. Other advantages and novel features may become apparent from the following detailed disclosure when considered in conjunction with the figures.

BRIEF DESCRIPTION OF THE FIGURES

The detailed description is described with reference to the accompanying figures. In these figures, the same left-most digit(s) of reference numbers usually indicates that these reference numbers appear for the first time in this document on the same figure. The use of similar reference numbers in different figures usually indicates similar or identical items.

DETAILED DESCRIPTION

This document discloses mounts for mounting accessories to weapons and more particularly this document discloses mounts for magnetically coupling flashlights to barrels of guns.

Figure 1:
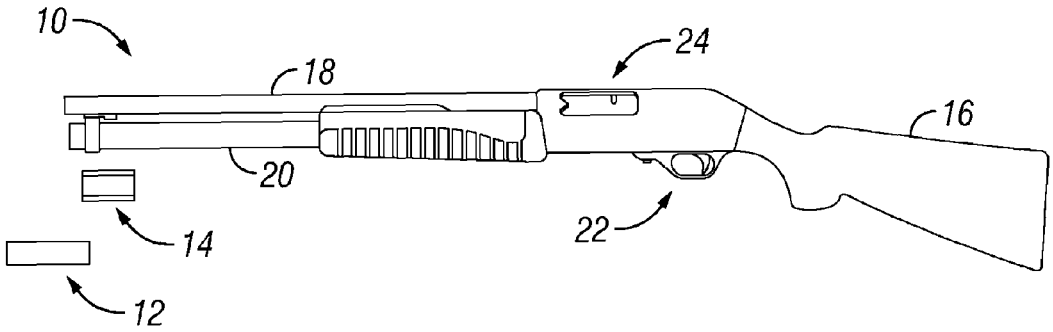
FIG. 1 illustrates a gun, an accessory mount, and a gun accessory.
Figure 2:
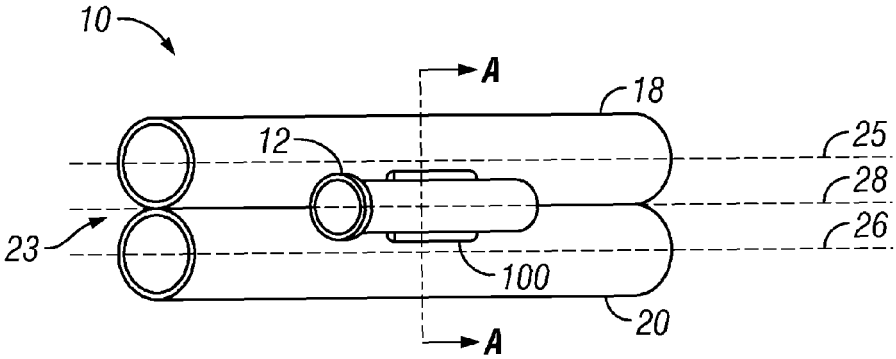
FIG. 2 illustrates an accessory mount and an accessory magnetically coupled to a gun.

FIG. 1 illustrates a gun, an accessory mount, and a gun accessory. More specifically, FIG. 1 illustrates the gun 10, a gun accessory 12 such as a light producing device, and an accessory mount 14. The gun 10 illustrated in FIG. 1 happens to be a shot gun although many other types of guns, weapons, etc, are included within the scope of the disclosure. For instance, the gun 10 could be a rifle, a semi-automatic weapon (for instance an AR-15, AK-47, an M-16, etc.), an automatic weapon, etc. With regard to the accessory 12, it can be any of a number of different accessories 12. For instance, the accessory 12 could be a light producing device (hereinafter a "light"), a gun-sight, an infrared scope, a laser sight, etc. FIG. 1 also shows the accessory mount 14 prior to it being mounted to the gun 10 and prior to receiving the accessory 12. As is discussed herein further, FIG. 2 illustrates the accessory mount 14 retaining an accessory 12 and being mounted to the gun 10. With reference again to FIG. 1, the gun 10 includes a variety of sub-assemblies and/or components such as a stock 16, a barrel 18, a magazine 20, trigger 22, and a chamber 24. Of course, other (or fewer) components could be included in the gun 10 such as for instance a second barrel (if the gun were a double-barreled shotgun).

In operation, a user might desire to shoot a target (not shown). To shoot at the target the user can brace the stock 16 against his or her shoulder, aim the barrel 18 at the target and (assuming that the gun 10 was loaded with a shell in the chamber 24) pull the trigger 22 to fire the gun 10. As the gun 10 fires, the projectile(s) accelerates through the barrel 18 and travels at a relatively high speed in the direction determined by the guidance provided to the projectile by the barrel 18. Accordingly, objects in the direction in which the barrel 18 points might be hit by the projectile.

Thus, if the area of the encounter is relatively dark, it might be desirable to attach a light to the barrel 18 to aid the user in seeing the target prior to deciding to fire the gun 10. It might, however, also be the case that the user has little time to mount the light on the barrel 18. Or it could be the case that it would be otherwise desirable to rapidly mount the light or other accessory 12 to the gun 10. More particularly, the user could use the accessory mount 14 of various embodiments to mount a light to the gun 10 by the barrel 18 (or some other component of the gun 10). To do so, the user could mount the accessory mount 14 to the barrel 18 and then couple the light to the accessory mount 14. In the alternative, or in addition, the user could couple the light and the accessory mount 14 first and then mount the accessory mount 100 to the barrel 18. Of course the user could take some other or additional course(s) of action.

Likewise, it might be the case that the user wishes to rapidly and conveniently detach the light (and/or the accessory mount 14) from the gun 10. Heretofore, mechanical assembly/disassembly of the gun 10 and the accessory mount 14 (and/or the accessory 12) was often too time consuming or inconvenient for some users. Various embodiments provide accessory mounts 14 (for accessories 12) which magnetically couple to ferromagnetic and/or ferrimagnetic components of various guns 10 and which allow for rapid (dis)assembly of the gun 10 from the accessory mount 14.

FIG. 2 illustrates an accessory mount and an accessory magnetically coupled to a gun. More particularly, FIG. 2 illustrates the accessory mount 100 with an accessory 12 retained therein and being magnetically coupled to the barrel 18 and/or magazine 20 of the gun 10. Here, it happens that both the barrel 18 and the magazine 20 are made of a ferromagnetic or ferromagnetic material and that the accessory mount 100 magnetically couples to the barrel 18 and the magazine 20 of the gun 10.

Moreover, the accessory mount 100 of the current embodiment protrudes partially into a crevice 23 defined by the barrel 18 and the magazine 20 and abuts the barrel 18 and the magazine 20. It might be worth noting that the barrel 18, the magazine 20, and the accessory mount 100 each define respective longitudinal axes 25, 26, and 28 which are generally parallel to each other in the current embodiment. Because of the parallel orientations of the barrel 18, the magazine 20, and the accessory mount 100 and the positioning of the accessory mount 100 in the crevices 23 (and its abutment to the barrel 18 and magazine 20), the accessory mount 100 tends to align itself with the direction in which the gun 10 might be aimed with little or no effort being employed by the user. Indeed, even if the accessory mount 100 becomes somewhat misaligned, the attractive magnetic force between the gun 10 and the accessory mount 100 will pull the accessory mount 100 back toward the crevices 23 thereby re-aligning the accessory mount 100 with the barrel 18 via guidance provided by the surfaces which define the crevice 23.

It might also be worth noting that since the accessory mount 100, of the current embodiment, magnetically couples to the gun 10, the accessory mount 100 generally remains coupled to the gun 10 at the position illustrated in FIG. 2 until pulled off by the user. Furthermore, if the magnet (or magnets) included in the accessory mount 100 are sufficiently strong, the magnetic coupling between the gun 10 and the accessory mount 100 can be sufficient to retain the accessory mount 100 adjacent to the gun 10 even when the accessory mount 100 happens to be mounted to the side of the barrel 18 and/or magazine 20 (which in the current embodiment are positioned one above the other). Thus, the magnetic coupling can be sufficient to prevent the weight of the accessory mount 100 (with or without the accessory 12) from pulling the accessory mount 100 away from the gun 10. In some embodiments, as is discussed further herein, the shapes and dimensions of the various portions of the accessory mount 100 can be selected to, in conjunction with the characteristics of the magnet(s), cause the foregoing and other effects.

With continuing reference to FIG. 2, it is likely that the gun 10 will generate a mechanical shock when it is fired. Heretofore, the gun 10 transmitted its firing shock to accessory mounts which had been mechanically coupled to guns 10. As a result, the mechanical attachment means of such accessory mounts tend to loosen and separate from the gun 10 after a few shots or even a single shot. Moreover, the mechanical shock transmitted to the accessory 12 also tends to break, damage, and/or degrade the accessory 12 with each firing of the gun 10.

In contrast, the magnetic coupling of the accessory mount 100 illustrated in FIG. 2 mitigates these results to a large degree if not eliminating them in their entirety. More particularly, because a magnetic field provides the coupling between the accessory mount 100 and the gun 10, mechanical shocks occurring in one will affect the other to a much less extent than as with mechanical couplings there between. Indeed, by its nature, the magnetic field will allow the accessory mount 100 to move relative to the gun 10 by an amount determined by those factors affecting the magnetic coupling between the accessory mount 100 and the gun 10. Thus, when the gun 10 fires, the mechanical firing shock will travel from the vicinity of the chamber 24 toward the location on the barrel 18 at which the accessory mount 100 is positioned. Whereupon the portion of the barrel 18 in that vicinity will accelerate and/or jerk either compressing or stretching the magnetic field in the volume between the accessory mount 100 and the barrel 18 and there about.

The distortion of the magnetic field will in turn cause the magnet of the accessory mount 100 to tend to move under the influence of the changing magnetic field. But, that movement (acceleration, jerk, etc. will be lessened by the storage of energy in the magnetic field. Therefore, since distorting a magnetic field stores energy in the magnetic field, the magnetic field decreases the shock transmitted to the accessory mount 100 while allowing a selected amount of relative movement between the accessory mount 100 and the gun 10. Again, the characteristics of the magnet(s) and the characteristics of the gun 10 and the accessory mount 100 can be selected to cause desired amounts of shock suppression, shock transmission and/or relative motion between the accessory mount 100 and the gun 10.

Figure 3:
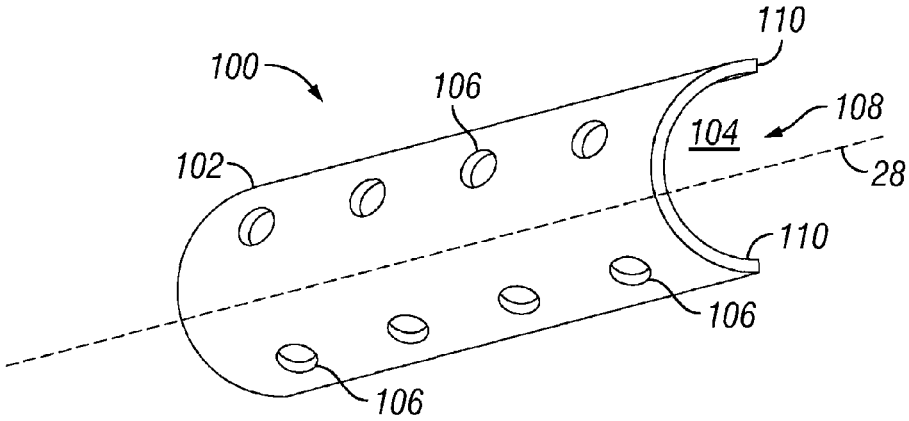
FIG. 3 is a perspective view of an accessory mount.

FIG. 3 is a perspective view of an accessory mount. The accessory mount 100 of the current embodiment can be mounted to a gun 10 and used to retain an accessory 12 as discussed with reference to FIGS. 1 and 2 and elsewhere herein. In FIG. 3 the accessory mount 100 includes a body 102 which defines an accessory cavity 104 and includes one or more magnets 106. Furthermore, the body 102 defines an aperture 108 and includes a pair of distal ends which can serve as detents 110. The accessory cavity 104 is shaped and dimensioned to receive and retain an accessory 12 such as a light (not shown). Thus, the shape and dimensions of a particular accessory cavity 104 can correspond to a particular accessory 12 or type or model thereof.

Moreover, the body 102 could define the accessory cavity 104 so that the aperture 108 opens in a direction perpendicular to the longitudinal axis 28. In some embodiments, the material of the body 102 could be resilient enough that the distal ends of the body 102 flex enough to allow the accessory 12 entry into the accesory cavity 104 while closing behind it. Thus, the accessory 12 could be pushed through the aperture 108 with the detents 110 closing behind it thereby mechanically retaining the accessory 12 in the accessory mount 100. In the alternative, or in addition, the body 102 might be shaped to receive the accessory 12 in the accessory cavity 104 from a longitudinal direction whereby the distal ends of the body 102 (that is, in the current embodiment, the detents 110) need not flex and can retain the accessory 12 in the accessory cavity 104.

FIG. 3 also illustrates that the body 102 of the accessory mount 100 can mechanically couple with the one or more magnets 106. In the embodiment illustrated by FIG. 3 the body 102 defines holes into which the magnets 106 can be placed and secured therein with an adhesive or by other means. In some embodiments though the body 102 is formed around the magnets 106 by, for instance, injection molding. However, in various embodiments, the entire body 102 could be a magnet 106 thereby simplifying some aspects of the manufacture of the accessory mount 100.

FIG. 3 also illustrates that for embodiments with more than one magnet 106 the magnets 106 can be arranged relative to one and other, and relative to the body 102, in a variety of ways. For instance, FIG. 3 illustrates that the magnets 106 can be arranged in parallel rows. As is discussed further herein with reference to FIG. 5, these rows of magnets 106 can correspond to the location of the barrel 18 and/or magazine 20 of a gun 10 (See FIGS. 1 and 2).

Figure 4:
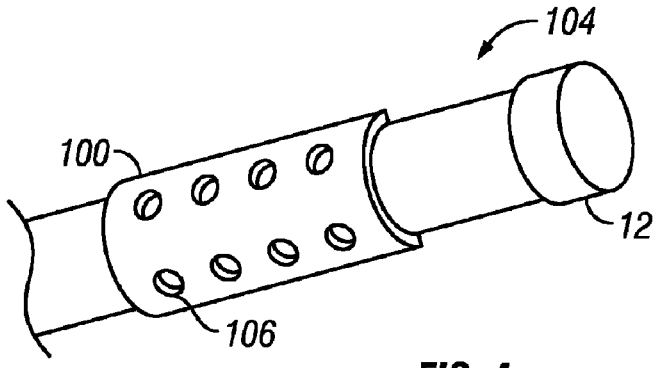
FIG. 4 is a perspective view of an accessory mount with an accessory retained therein.

FIG. 4 is a perspective view of an accessory mount with an accessory retained therein. Again, the accessory 12 is retained in the accessory cavity 104 (not shown) by the detents 110 of the body 102. And, being retained in the accessory cavity 104 (which is on the side of the accessory mount 100 opposite the side which will sometimes abut the gun 10), the accessory 12 does not interfere with the mounting of the accessory mount 100 to the gun 10. Furthermore, if the accessory 12 happens to be made of ferromagnetic or ferrimagnetic material (or might otherwise influence the magnetic fields generated by the magnets 106) the magnets 106 can be chosen to account for this factor while providing the magnetic (de)coupling capabilities (and/or the shock absorption capabilities) discussed further elsewhere herein.

Figure 5:
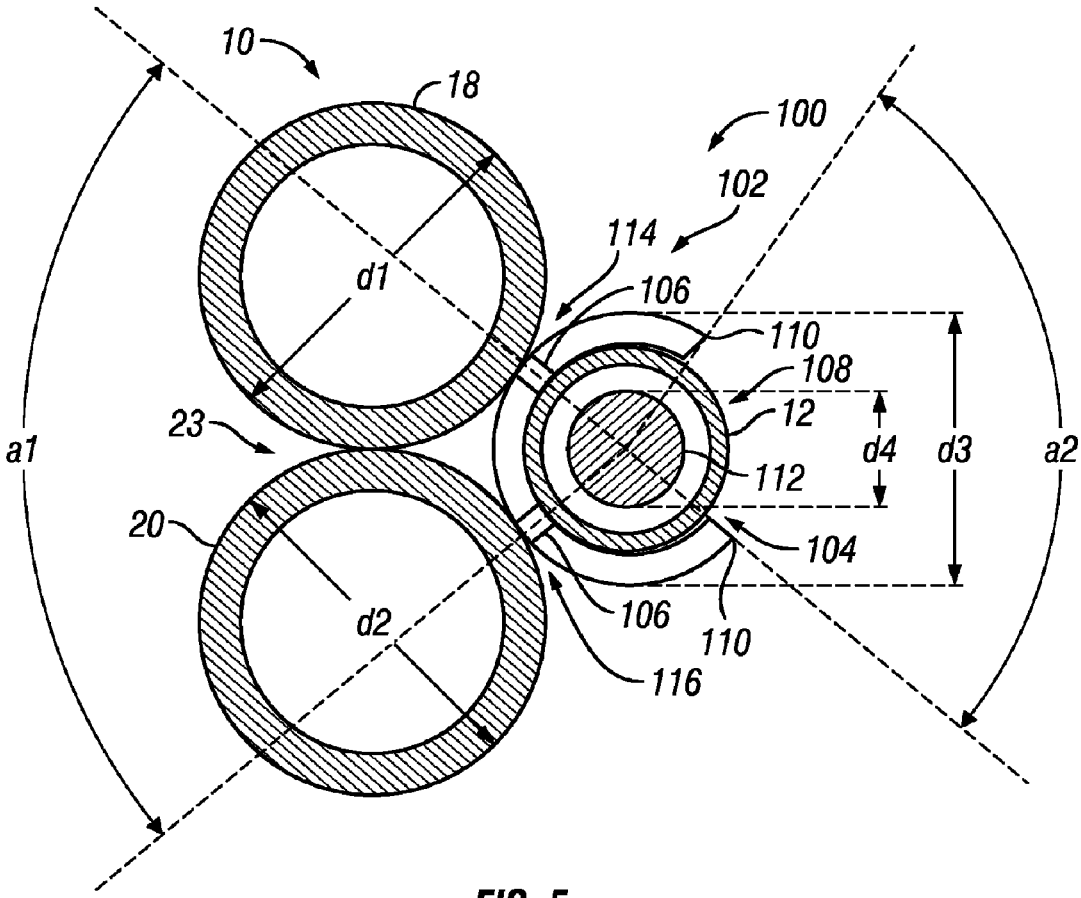
FIG. 5 is a cross-sectional view of an accessory mount magnetically coupled to a gun with an accessory retained in the accessory mount.

FIG. 5 is a cross-sectional view of an accessory mount magnetically coupled to a gun with an accessory retained in the accessory mount. More particularly, FIG. 5 illustrates a cross-sectional view of the gun 10 and an accessory mount 100 as viewed along the line AA in FIG. 2. FIG. 5 therefore illustrates the barrel 18, the magazine 20, the crevices 23, the accessory mount 100, and the accessory 12. FIG. 5 also illustrates that the accessory 12 can be a battery powered flashlight which contains one or more batteries 112 therein. While the bodies 102 of accessory mounts 100 of some embodiments can be shaped and dimensioned to hold a particular model of accessory 12 (or particular models of accessories 12) which use one of a particular battery 112 size, the bodies 102 of various other accessory mounts 100 can possess sufficient resilience (other characteristics and/or other features) to retain a variety of accessories 12 with differing dimensions, shapes, etc. Indeed, while some embodiments allow for accessories 12 powered by AA, AAA, C, D batteries 112 and/or batteries 112 of other sizes, still other embodiments allow for accessories 12 powered by other means (for instance, solar cells). Various embodiments also allow for even unpowered accessories 12.

With regard to some illustrative shapes and dimensions of the accessory mount 100 and the gun 10, it will again be noted that the accessory mount 100 of the current embodiment abuts the barrel 18 and magazine 20 of the gun 10 and is aligned in the crevices 23 there between. Moreover, the barrel 18 defines an outer diameter d1 while the magazine 20 and the accessory mount 100 define respectively, outer diameters d2 and d3. Of course, the accessory 12 can define an inner diameter d4 allowing, if desired, internal storage of one or more batteries 112. Moreover, the cross-sectional shapes (here circular) of the barrel 18, the magazine 20, and the accessory mount 100 cause the foregoing components to come into contact points 114 and 116. Since these contact points 114 and 116 define the positions on the body 102 of the accessory mount 100 which come closest to the barrel 18 and/or the magazine 20, in some embodiments, the magnets 106 are positioned in or near corresponding locations on the body 102 of the accessory mount 100. Thus, for a given combination of a particular type of gun 10 and a particular accessory mount 100 the geometry of the combination defines an angle a1 between the contact points 114 and 116 (and hence magnets 106) relative to the center (or other reference point) of the accessory mount 100.

In various combinations the diameters d1, d2, d3, the angle a1 (between the magnets 106), and the characteristics of the magnets 106 (such as their magnetic field strengths) can be selected to yield characteristics of the magnetic coupling between the accessory mount 100 and the gun 10. Indeed, the diameters d1, d2, and d3, the angle a1, and the magnets 106 can be selected so that the magnetic fields produce a selected static force within a desired range and shock damping within another selected range while also allowing a selected range of relative motion between the gun 10 and the accessory mount 100. Indeed, such selections can be made on a case-by-case basis, on a gun type-by-gun type basis, and/or an ammunition type-by-ammunition type basis. Note that since the ammunition type can correlate to the expected mechanical shock generated when the gun 10 fires the ammunition type can therefore have a bearing on the desired magnetic field of the magnet(s) 106.

The characteristics of the gun 10 and characteristics of the accessory mount 100 can be selected so that in some embodiments the accessory mount 100 attaches to the gun 10 by simply placing it adjacent to the barrel 18 and/or the magazine 20 while allowing the user to detach the accessory mount 100 there from by applying a selected force to separate the accessory mount 100 from the gun 10. In such embodiments the user can "slap" the accessory mount 100 to the gun 10 to attach (and align) the two objects to each other and can "rip" the accessory mount 100 off the gun 10 with quick hand movements.

Also, FIG. 5 illustrates other aspects of the appliance retention cavity 104 of the accessory mount 100. For instance, the distal ends of the body 102 (or the detents 110 as might be the case) can define an angle a2 between themselves relative to the center (or other reference point) associated with the body 102. The angle a2 could be in a range between about 90 degrees and 180 degrees although other angles a2 are within the scope of the disclosure. By selecting the angle a2 and other aspects of the body 102 (such as its material) a user can determine the retention/release capabilities of the detents 110. In some embodiments, therefore, the body 102 is made of ABS polycarbonate plastic while the angle a2 is about 130 degrees. Moreover, the magnets 206 can be selected from any type of magnets such as ceramic magnets, ferrite magnets, alnico magnets, samarium cobalt magnets, neodymium iron boron magnets, neodymium magnets, etc. In some embodiments, the magnets 106 are model number N38EH, ⅜"×⅛" NdFeB Disc Magnets available from China Rare Earth Magnets (CREM) Ltd. of ShenZhen, China.

Figure 6:
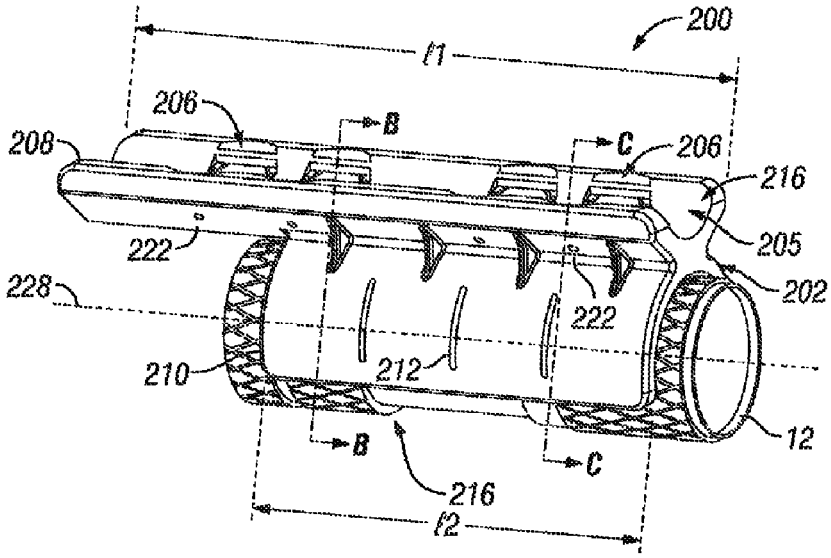
FIG. 6 is a perspective view of an accessory mount.

FIG. 6 is a perspective view of an accessory mount. The accessory mount 200 of the current embodiment can hang from underneath the barrel 18 or magazine 20 of a gun 10. Indeed, FIG. 6 illustrates the accessory mount 200 with the accessory 12 hanging from the accessory mount 200 (with the gun 10 not being present). If the gun 10 includes an extended magazine 20, the accessory mount 200 can hang from that magazine. In the alternative, or in addition, the accessory mount 200 can hang from the barrel 18 of a gun 10 without an extended magazine 20. Indeed, because of the magnetic coupling between the accessory mount 200 and the ferromagnetic and/or ferrimagnetic objects to which it can couple, the accessory mount 200 can mount to any generally cylindrical object of suitable material. Of course, the accessory mount 200 could be shaped and dimensioned to mount to objects of other shapes without departing from the scope of the disclosure.

In the current embodiment the accessory mount 200 includes a body 202, defines a weapon cavity 205, and a magnet or magnets 206. Furthermore, the body 202 of the accessory mount 200 defines a weapon portion 208 and an accessory portion 210. Various other features 212 can be included in/on the accessory mount 200 as desired. However, the accessory portion 210 can define a longitudinal axis 228 which parallels the longitudinal axis of the barrel 18 when the accessory mount 200 is mounted to the barrel 18. Therefore, provided that the weapon portion 208 and the accessory portion 210 fix the relative orientation between the barrel 18 and the accessory 12, the accessory 12 can point in the direction in which the gun 10 is aimed. The shapes and dimensions of the weapon portion 208 can be selected with regard to a type or model of gun 10 to yield desired mounting capabilities. Indeed, in some embodiments, the accessory mount 200 can rest atop the barrel 18 of the gun 10 thereby allowing the weight of the accessory mount 200 (and accessory 12 if present) to aid in pressing the accessory mount 200 and gun 10 together in lieu of or in addition to magnets 206.

Note also that the weapon portion 208 of the current embodiment defines a weapon cavity 205 with an opening 216 to allow the gun 10 (or barrel 18 thereof) to be moved into the weapon cavity 205 in a direction perpendicular to the longitudinal axis 228. However, other configurations are within the scope of the disclosure. For instance, the weapon cavity 205 could be shaped and dimensioned to allow the weapon cavity 205 to receive the barrel 18 of the gun 10 in a longitudinal direction.

With continued reference to FIG. 6, the drawing also illustrates the accessory portion 210. As is illustrated, the accessory portion 210 defines an accessory cavity (not shown due to the presence of the accessory 12). In addition, or in the alternative, in some embodiments the accessory portion 210 also includes magnets 206.

Furthermore, FIG. 6 (along with FIG. 9) illustrates that the weapon portion 208 can include two rows of four magnets 206 on its respective sides. The characteristics of the magnets 206 and the shapes and dimensions of the overall accessory mount 200 can be selected so that the magnetic coupling between the magnets 206 and the gun 10 is sufficient to retain the accessory mount 200 in abutting relationship with the gun 10 even if the accessory mount 200 were hanging from the gun 10 or otherwise oriented relative thereto.

Moreover, in the current embodiment, the shapes and dimensions of the various portions of the accessory mount 200 can be selected so as to align the accessory mount 200 (and therefore the accessory 12) with the aim of the gun 10. For instance, in embodiments wherein the gun 10 has a single barrel 18 (and no magazine 20 or other component to give rise to a crevice 23 as illustrated in FIG. 1), a length 11 of the weapon portion 208 can be selected to yield a stable mounting of the accessory mount 200 to the gun 10. In addition, or in the alternative, a length 12 of the accessory portion 210 can be selected to balance the accessory 12 in the accessory mount 200 and/or to otherwise yield a stable retention of the accessory 12 in the accessory mount 200

FIG. 6 also illustrates other features of the accessory mount 200. For instance, various features 212 could be incorporate onto accessory mounts 200 (on either the weapon portion 208 or the accessory portion 210) to aid the user in gripping the accessory mount 200 during its mounting to, or dismounting from, the gun 10. In addition, or in the alternative, such features 212 such as slits can aid in allowing the gun 10 (or perhaps the barrel 18 of the gun 10) to cool between firings. Yet other features 212 of the accessory mount 200 can provide a rugged, tough, etc. appearance. For instance, the gun mount 200 can define a slot 220 (see FIG. 9) which allows the weapon portion 208 to fit around a bayonet lug or other protrusion present on some guns 10.

Figure 7:
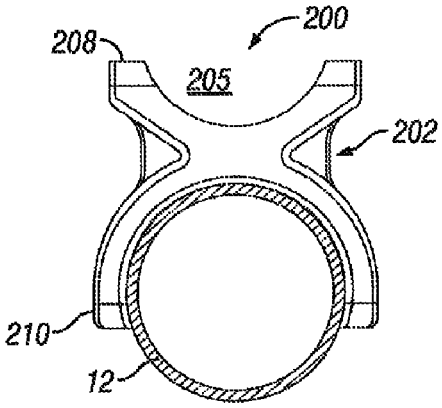
FIG. 7 is a cross-sectional view of an accessory mount.
Figure 8:
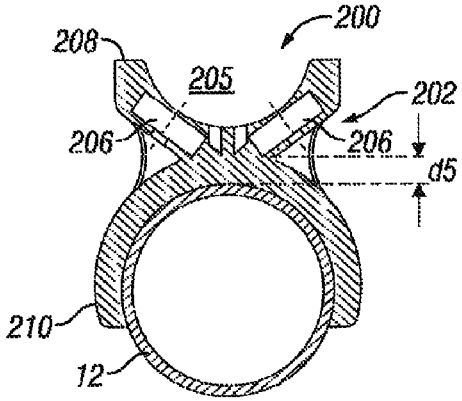
FIG. 8 is another cross-sectional view of an accessory mount.

FIG. 7 is a cross-sectional view of an accessory mount. In FIG. 7, a cross-sectional view taken along line BB of FIG. 6 and between the magnets 206 is illustrated. FIG. 8 is another cross-sectional view of an accessory mount 200. In FIG. 8, a cross-sectional view taken along line CC of FIG. 6 (at which a pair of the magnets 206 are located) is illustrated. In some embodiments, though, the magnets 206 are spaced apart from the barrel 18 of the gun 10 by some distance. Thus, the shapes and dimensions of the body 202 can be chosen to provide an air gap between the magnets 206 and the gun 10. That air gap can be filled partially or totally by the body 202 which can be made of a material chosen to increase/decrease the strength of the magnetic field of the magnets 206 therein.

In some embodiments the weapon portion 208 can define an opening through which the weapon or a portion thereof (for instance the barrel 18 of the gun 10) can be moved into the weapon cavity 205 to magnetically couple with the magnets 206. Thus, the weapon portion 208 can have a semicircular cross-section with an arc of about 180 degrees (so that the opening spans the other 180 degrees). Of course, since the magnets 206 magnetically couple with the weapon and therefore hold the weapon and the accessory mount 200 together no mechanical retention device is necessary in the current embodiment. Rather, the accessory mount 200 (and the accessory 12) hangs from the weapon and are suspended there from due to the magnetic coupling. Indeed, in some embodiments, the arc of the weapon portion 208 spans less than 180 degrees. However, if desired, the arc of the weapon portion 208 could span more than 180 degrees so that the ends thereof define detents (or other structures) to provide some mechanical capability to retain the weapon in the weapon portion 208.

Figure 9:
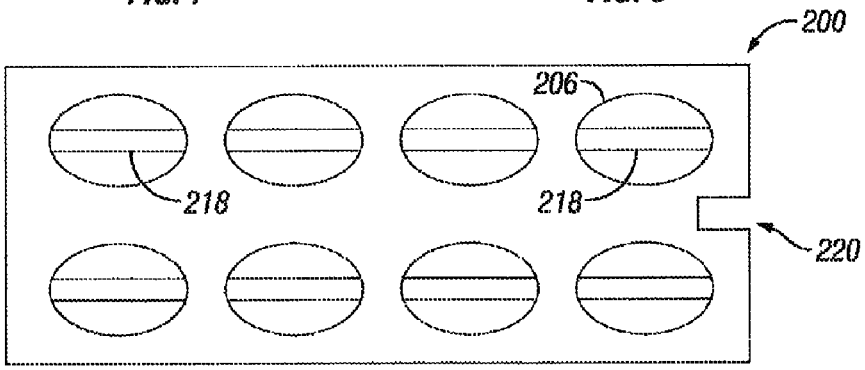
FIG. 9 is a top plan view of an accessory mount.

FIG. 9 is a top plan view of an accessory mount. In FIG. 9, two rows of magnets 206 of the accessory portion 210 are illustrated. These magnets 206 (being in relatively close proximity to the accessory cavity) can aid in retaining ferromagnetic or ferrimagnetic accessories 12 in the accessory cavity. The magnets 206 can also, via the reach of their magnetic fields, magnetically couple with the gun 10 or portions thereof to couple the accessory mount 200 and the gun 10. To that end and/or others, the weapon portion 208 can include features such as cross bars 218 to mechanically couple the magnets 206 and the accessory mount 200. The cross bars 218 can fill (either partially or completely) an air gap between the magnets 206 and the gun 10. Thus the material from which they can be fabricated can be selected so as to alter the magnetic field (and coupling) between the magnets 206 and the gun 10 as might be desired.

Figure 10:
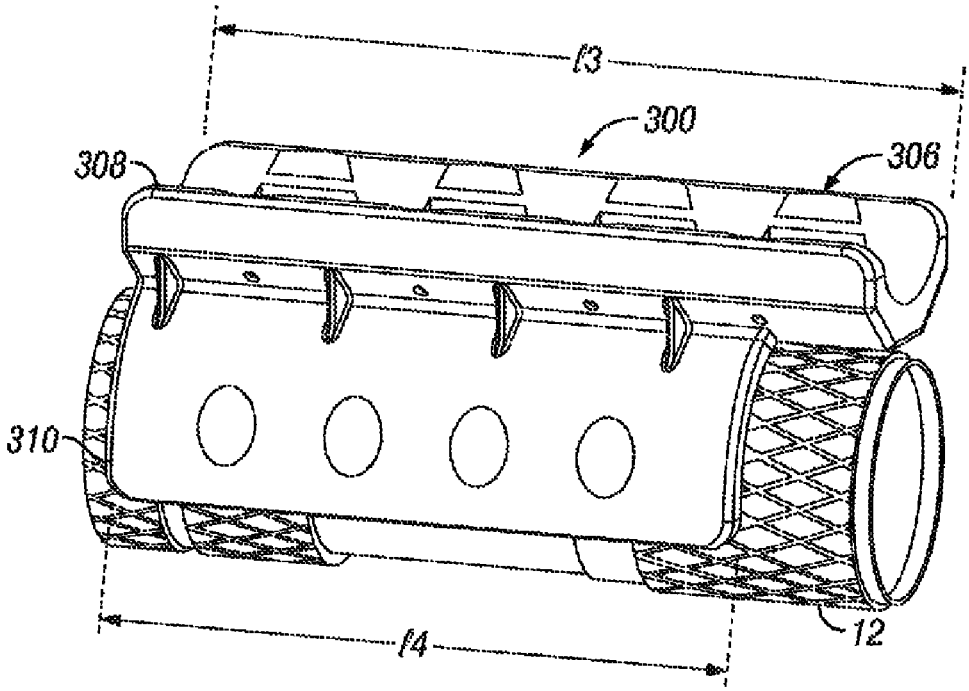
FIG. 10 is a perspective view of another accessory mount.

FIG. 10 is a perspective view of another accessory mount. The accessory mount 300 of the embodiment illustrated by FIG. 10 happens to be shaped and dimensioned to be coupled to a shotgun barrel 18. Thus, in comparison to the accessory mount 200 of FIG. 6 (which happens to be shaped and dimensioned to couple to an AR-15), the accessory mount 300 can have a weapon portion 308 with a larger interior diameter. Moreover, the lengths 11 (see FIG. 6), 12, 13, and 14 of various gun mounts 200 and 300 can be different to accommodate conditions which might affect their mounting to various weapons. Thus, FIGS. 6 and 10 illustrate that various weapon mounts 200 and 300 can accommodate different weapon types and different accessories 12.

With reference again to FIG. 6, in some embodiments the body 202 of the accessory mount 200 is injection molded. Thus, the die in which the accessory mount 200 can be manufactured can include pins, posts, or other features to pre-position the magnets 206 in the mold. More particularly, these pins can pre-position the magnets 206 to be quite close to the weapon cavity 216 and therefore the gun 10 (when present). These pins can leave holes 222 in the body 202 at appropriate locations without departing from the scope of the disclosure. Moreover, various gate locations can be selected to facilitate the injection of a polymer, its precursor(s), or some other suitable material for such embodiments. For instance, a gate location at either the proximal or distal end of the accessory mount 202 and between the weapon portion 208 and the accessory portion 210 could be selected.

Furthermore, even though the weapon portion 208 or 308 can accommodate weapons of differing configurations, the accessory portion 210 or 310 can accommodate the same type of accessory 12. Thus, the accessory portions 210 and 310 could have the same lengths 12 (see FIG. 6) and 14 and inner diameters. However, this situation need not be the case. In some embodiments, various accessory portions 210 and 310 have different lengths 12 and 14 and inner diameters.

Moreover, other embodiments vary from one and other in other ways. For instance, the magnets 206 or 306 could be located on or in the accessory portions 210 or 310. In the alternative, or in addition, the magnets 206 and 306 could be located in or on the region of the body 202 between the weapon portions 208 and 308 and the accessory portions 210 and 310 without departing from the scope of the disclosure. Such embodiments could therefore be shaped and dimensioned in such a way as to allow the magnets 206 and 306 to magnetically couple with the accessory 12 as well as the gun 10 therefore securing both in the accessory mounts 200 and 300.

CONCLUSION

Although the subject matter has been disclosed in language specific to structural features and/or methodological acts, it is to be understood that the subject matter defined in the appended claims is not necessarily limited to the specific features or acts disclosed above. Rather, the specific features and acts disclosed above are disclosed as non-limiting forms of implementing the claimed subject matter.

The invention claimed is:

1. An apparatus for releasably attaching a light producing device to a gun which includes a barrel, the apparatus comprising:

a body shaped and dimension to define a retention cavity to receive the light producing device;

a detent coupled to the body and being shaped and dimensioned to retain the light producing device in the retention cavity; and a magnet coupled to the body and being positioned relative to the body to magnetically communicate with the barrel of the gun when the apparatus is coupled to the gun, the magnet being configured to have a magnetic strength sufficient to magnetically couple with the barrel of the gun during a shock associated with a firing of the gun thereby releasably attaching the light producing device to the gun when the light producing device is retained in the retention cavity by the detent.

2. The apparatus of claim 1 wherein the body defines a mounting cavity to receive the barrel of the gun.

3. The apparatus of claim 1 wherein the magnet is one of a plurality of magnets positioned relative to the body to magnetically communicate with the barrel of the gun when the apparatus is coupled to the gun.

4. The apparatus of claim 1 wherein the body is shaped and dimensioned to align the light producing device along an axis of the barrel.

5. The apparatus of claim 1 wherein the detent is an integral part of the body.

6. The apparatus of claim 1 wherein the detent is also shaped and dimensioned to release the light.

7. The apparatus of claim 1 wherein the magnet is on a surface of the body.

8. The apparatus of claim 1 wherein the magnet is in the body.

9. A mount to mount an accessory to a weapon which includes a barrel, the mount comprising:

a body shaped and dimensioned to mechanically receive the accessory; and a magnet mechanically coupled to the body and causing a magnetic field with a strength sufficient to, in conjunction with the shape and dimensions of the body, the position of the magnet relative to the body, and the position of the magnet relative to the barrel when the body abuts the barrel, releasably and magnetically couple the magnet and the barrel during a shock associated with a firing of the weapon.

10. The mount of claim 9 wherein the magnetic field strength is sufficient to limit a range of motion of the mount relative to the weapon during a firing of the weapon to within about one quarter of an inch.

11. The mount of claim 9 wherein the magnet and the body are integral portions of the mount.

12. The mount of claim 9 further comprising a plurality of magnets wherein the magnet is a first magnet of the plurality of magnets.

13. The mount of claim 12 wherein the plurality of magnets is arranged in a row to be parallel to the barrel of the weapon when the body abuts the barrel.

14. The mount of claim 12 wherein the plurality of magnets is arranged in two rows to be parallel to the barrel of the weapon when the body abuts the barrel.

15. The mount of claim 14 wherein the barrel also includes a magazine and one of the rows of magnets is positioned to abut the barrel and the other row of magnets is positioned to abut the magazine of the barrel when the body abuts the barrel.

16. The mount of claim 9 wherein the body defines an accessory retention cavity and a barrel retention cavity for respectively receiving the accessory and the barrel of the weapon.

17. The mount of claim 9 wherein the body is shaped and dimensioned to align the accessory along a longitudinal axis of the barrel.

18. The mount of claim 9 wherein the accessory is a flashlight.

19. A mount to mount a light to a gun which includes a barrel, the mount comprising:

a body defining a light retention cavity and a barrel retention cavity for respectively retaining the light and the barrel of the gun; and a magnet mechanically coupled to the body and causing a magnetic field with a strength sufficient to, in conjunction with the shape and dimensions of the body, the position of the magnet relative to the body and the position of the magnet relative to the barrel when the body abuts the barrel, releasably and magnetically couple the magnet and the barrel wherein the magnetic field strength is sufficient to limit a range of motion of the mount relative to the gun during the firing of the gun to within about one quarter of an inch or less during the presence of a mechanical shock created during a firing of the gun.

* * * * *